United States Patent [19]

Noon et al.

[11] Patent Number: 4,606,169

[45] Date of Patent: Aug. 19, 1986

[54] WALL CONSTRUCTION

[76] Inventors: Peter T. Noon, 292 Whalley Rd., Clayton-le-Moors, Accrington; Ronald Pennor, Fleet Green, Higher Tatham, Lower Gill, Lancaster, United Kingdom

[21] Appl. No.: 538,824

[22] Filed: Oct. 5, 1983

[30] Foreign Application Priority Data

Oct. 9, 1982 [GB] United Kingdom ..... 8228942

[51] Int. Cl.[4] ..... E04B 1/00

[52] U.S. Cl. ..... 52/747; 52/261; 52/266; 52/268; 52/309.4; 52/309.9; 52/309.12; 52/424; 52/425; 52/748

[58] Field of Search ..... 52/202, 261, 266, 267, 52/268, 424, 425, 747, 309.1, 309.4, 309.12

[56] References Cited

U.S. PATENT DOCUMENTS

| | | | |
|---|---|---|---|
| 1,671,266 | 5/1928 | Ashenhurst | 52/425 |
| 1,846,849 | 2/1932 | Covell | 52/425 |
| 3,221,457 | 12/1965 | Vevoda | 52/425 |
| 4,019,296 | 4/1977 | Jochmann | 52/747 |
| 4,315,391 | 2/1982 | Piazza | 52/309.5 X |

*Primary Examiner*—Thurman K. Page

*Attorney, Agent, or Firm*—Fisher, Christen & Sabol

[57] ABSTRACT

A method of constructing thermally insulated cavity wall in a quick manner with relatively unskilled labor comprises laying bricks, blocks or the like in successive courses without mortar or adhesive therebetween and injecting a foamable material into the cavity progressively as the wall is constructed. Joint spaces may be provided between adjacent blocks in each course so that the foamable material may bond to for example plaster board applied to the inner wall portion.

4 Claims, 5 Drawing Figures

WALL CONSTRUCTION

This invention relates to walls and to methods of constructing the same.

Conventionally walls are constructed of bricks or blocks laid with mortar or the like bonding material between adjacent bricks or blocks. This is a time consuming method of construction requiring skilled labour, and is therefore costly. It is known to build walls 'dry', i.e. without the mortar between the bricks or blocks, but this does not provide a strong enough wall for most applications.

In an effort to conserve heat energy it is now customary to apply insulating material to walls of buildings or to build such walls of materials which provide a degree of heat insulation.

For this purpose it is known to inject a foamable material into the cavity of a cavity wall. It is also known to apply a coating or liner of an insulating material to the inside or to the outside of a wall to reduce the passage of heat therethrough. Such a coating may be applied by spraying. In these cases the application of the insulating material is performed after the building of the wall is completed and therefore represents an additional time consuming and therefore expensive operation. Furthermore if an insulation material such as foam is used as a coating to a wall it is prone to damage as it possesses little structural integrity. It is also known to build walls in the conventional manner using blocks of a thermally insulating material or blocks having foam filled cavities therein, or to fill the cavity of a conventional cavity wall with foam "boards" during building, but this latter method requires the use of special ties to retain the boards in position and the region of the butt-joints between adjacent boards can be a source of heat loss through the wall.

Conventional or dry built walls may be rendered after building, preferably on both sides, the rendering providing a degree of bonding between the bricks or blocks of the wall. A suitable material for this process comprises a cement and glass fibre mix, the glass fibres reducing the tendency for the rendering to crack. However, such rendering materials do not provide good heat insulation for the wall, and are relatively expensive.

It is an object of the present invention to provide a method of constructing a wall of bricks, blocks, stones or the like (hereinafter referred to as blocks) which is simple and quick to carry out but results in a strong wall. It is a further object of the invention to provide an insulated wall which is less costly than walls built by known methods with subsequent insulation applied thereto but has good heat insulation properties incorporated therein.

The invention provides a method of constructing a wall comprising laying a plurality of building blocks in successive courses in block to block contact without a bonding material therebetween to form at least one wall portion of a wall having a cavity between two wall portions and injecting a foamable material into said cavity progressively whilst said wall portion is being constructed.

By means of the invention walls can be built quickly without the skilled labour required for building by conventional brick-laying techniques using mortar. Furthermore, to produce an insulated wall the application of an insulating layer of foam after the wall is built is not required, thereby saving time and expense. In addition walls having large numbers of courses can be built quickly without the requirement of waiting until the mortar between lower courses has fully set. Since the foamable material is injected into a cavity in the wall it is not prone to being damaged as is the case with foam coatings on the outside of a wall.

The wall may be a double or cavity wall, i.e. formed of two spaced single wall constructions, in which case the foamable material is located in the cavity between the wall constructions, and not only bonds the blocks of one wall construction to each other, but also bonds the two wall constructions together in the manner of conventional wall ties.

Alternatively, the wall may be constructed of blocks having at least one cavity extending therethrough so as to provide said two spaced wall portions. In this case preferably each cavity is tapered whereby when such blocks are laid above one another a part of an upper face of one block bounds the cavity, and is left uncovered by, the blocks above. This allows foamable material injected into the cavity to bond to said upper face as well as to the sides of the cavity, thereby strengthening the bond between consecutive courses of blocks.

Embodiments of the invention will now be described with reference to the accompanying drawings.

BRIEF DESCRIPTION OF THE DRAWINGS

Referring now to FIG. 1 there is shown a double or cavity wall 10 of blocks 11. The wall 10 comprises an inner wall construction 12 and an outer wall construction 13 with initially a cavity 14 therebetween. Both the inner and outer wall 12,13 are constructed "dry", i.e. there is no mortar or other adhesive between the courses or between adjacent blocks 11 in any one course. Thus the blocks 11 may be laid quickly and easily by a less skilled person that is required for conventional brick-laying. Furthermore any number of courses may be laid without having to wait for mortar or the like to set between the lowermost courses. As the blocks 11 are laid, a foamable material 16 is injected, i.e. sprayed, into the cavity 14 from a nozzle 17. After each new, temporarily uppermost, course is laid the foamable material is sprayed into the cavity 14 in a quantity sufficient when foamed to rise to a height of approximately a quarter of the height of the temporarily uppermost course. This bonds the blocks of the temporarily uppermost course and those of the course beneath together whilst the tendency of the pressure build-up during foaming to force the blocks of the temporarily uppermost course apart is minimised. This foam then "sets" whilst the next course of blocks is being laid. When the ultimate uppermost course has been laid the cavity 14 is "topped-up" after setting of the foam 16 which bonds the blocks 11 of that course to the course beneath. Three or four passes of nozzle 17 may be made for each fill of foamable material 16 to further minimize the lateral pressure on the blocks 11 during setting of the foamable material 16 sprayed during the previous pass.

Figure 1:
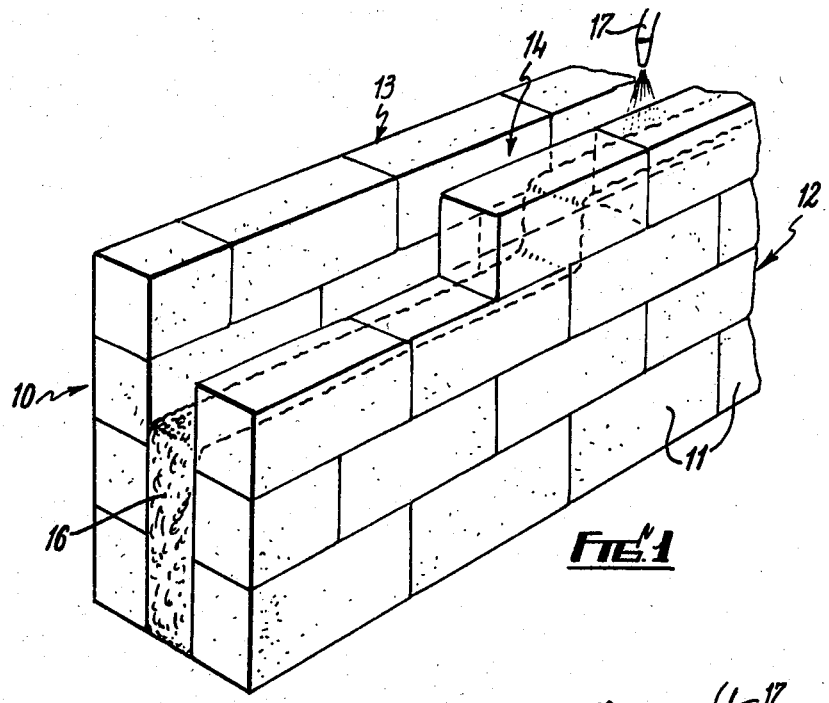
FIG. 1 is a perspective view of one arrangement of double wall.

Preferably the foamable material 16 is a urethane foam, for example a closed cell polyurethane foam, so as to provide a good bond between the blocks 11 of either wall construction 12,13 and also between the two wall constructions 12,13 themselves to form a very strong wall. The foam 16 in consequence fulfils three functions which in a cavity wall of conventional form are provided by three separate entities, namely mortar between the bricks or blocks to bond them together, ties between the inner and outer wall constructions, and foam within the cavity for insulation purposes. Thus not only is a wall built in accordance with the method of the invention constructed in a quick and simple manner but the time necessary for a subsequent cavity filling operation is avoided. A building whose walls are constructed by the present method can be ready for use within one hour of completion since the foamable material will have set to provide a good bond between the bricks or blocks in that time. Furthermore with a wall constructed in accordance with the method of the invention it is ensured that the cavity 14 is filled, this not being the case when foamable material is injected into a cavity after the wall is completed. Also a urethane foam is preferred in the present case to provide better insulation properties than the urea formaldehyde foam materials used in foam filled cavity wall constructions. Walls of the type illustrated in FIG. 1 and constructed of blocks are considered to be ideally suited for agricultural buildings, such as pig houses and vegetable stores, industrial premises, cold stores and refrigeration houses, although such walls if rendered or clad on the outside and plastered on the inside would be suited to domestic, shop and office properties. Alternatively the outer wall could be of brick construction and the inner wall of block construction if a more conventional outer appearance is required.

As a further alternative the outer wall 13 may be of brick or block construction and the inner wall 12 of timber and/or board construction.

For existing buildings of single wall construction the method of the present invention may be conveniently employed. In this case the outer wall 13 of FIG. 1 may be regarded as the existing wall of the building and may be of bricks and mortar, stone and mortar, dry stone, corrugated steel or asbestos construction. A new inner wall 12 is constructed with bricks or blocks 11 in the "dry" manner shown and foamable material 16 is injected progressively between the existing wall 13 and the wall 12 under construction. Particularly if thin blocks, e.g. 2" or 5 cm thick, are used for the inner wall 12, good insulation of the resulting wall 10 is received with less reduction in the volume of the building than would occur with an internal wall built of thermal blocks giving the same insulation properties.

Figure 2:
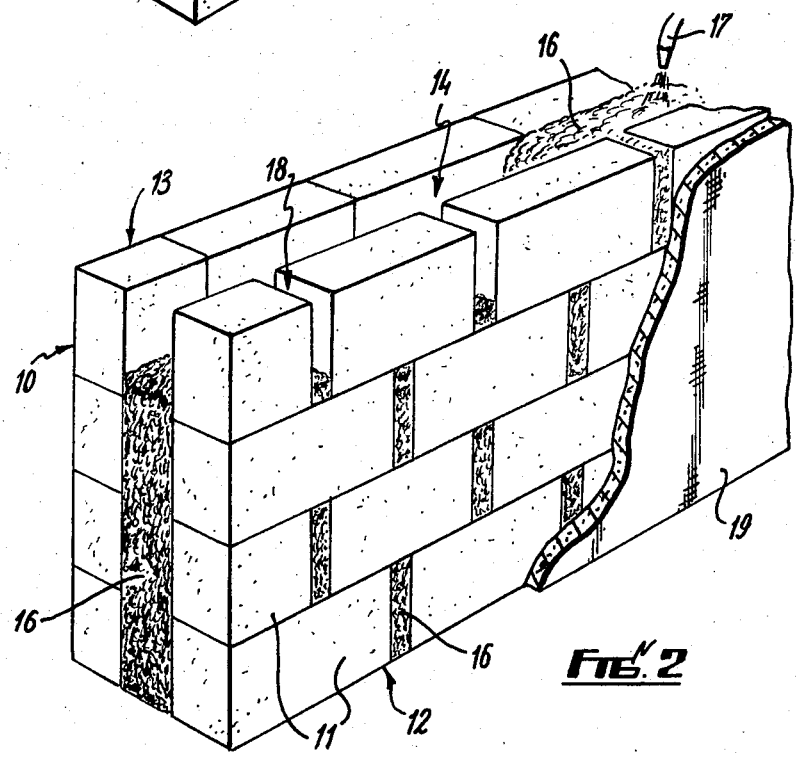
FIG. 2 is a perspective view of a second arrangement of wall.

Particularly for domestic, shop or office premises, in which a plastered or clad inner wall is required, the arrangement shown in FIG. 2 is suitable. In this case the inner wall 12 is constructed with spaces 18 between the blocks 11 in each course. Plasterboard or other lining panels 19 are placed against the inner wall 12 and the foamable material 16, when injected into the cavity 14 spreads through the gaps 18 to bond the panels 19 to the inner wall 12. By this means the operation of securing the panels 19 in position is combined with the operation of building the wall, thereby providing an overall saving of time in producing the finished wall.

Figure 5:
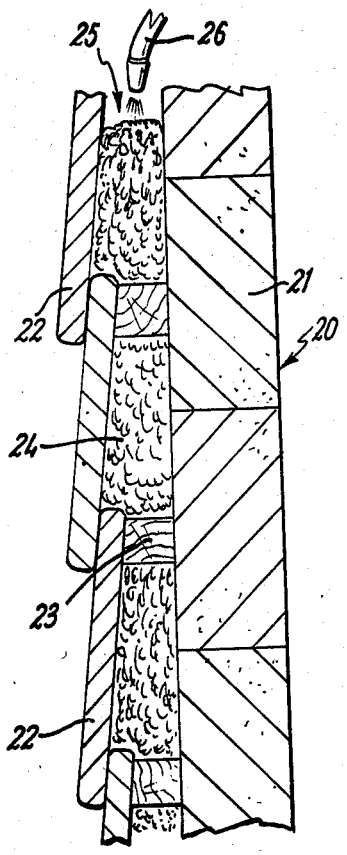
FIG. 5 is a sectional end elevation of a wall having an outer cladding applied thereto.

Another form of wall construction, particularly for use at the upper storeys of domestic or industrial properties, comprises a single wall of bricks or blocks and an outer cladding of tiles, planks or other cladding forms. The outer cladding 'wall' is spaced from the inner brick or block wall by battens, thereby providing a cavity between the two wall portions. A wall of this type, constructed in accordance with the present method, is shown in FIG. 5. In this case the inner wall 20 is constructed 'dry' of bricks or blocks 21. The tiles or planks 22 and battens or spacers 23 are placed against the outer surface of wall 20 and foamable material 24 is injected from nozzle 26 into the cavity 25 between the wall 20 and the tiles or planks 22. The foam 24 provides a good bond between the tiles or planks 22 and the wall 20, good thermal and weather insulation properties.

Figure 3:
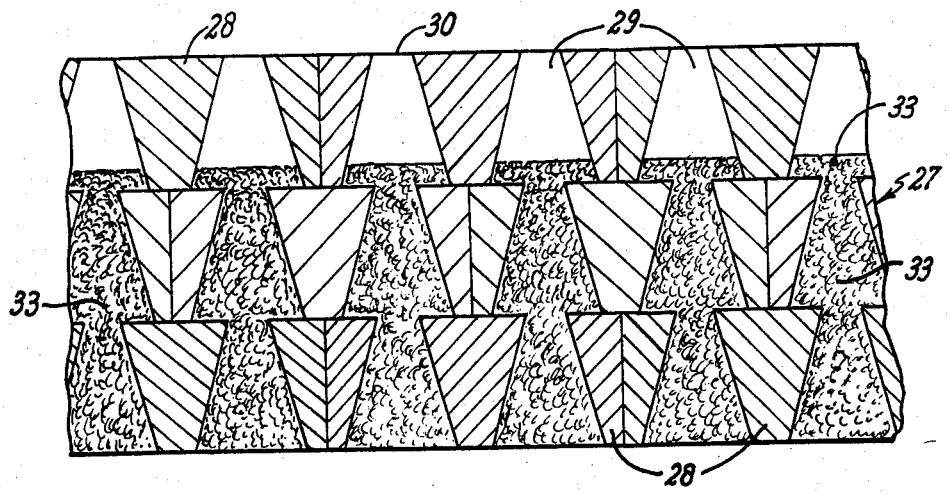
FIG. 3 is a sectional elevation of an arrangement of wall of blocks having cavities therein.
Figure 4:
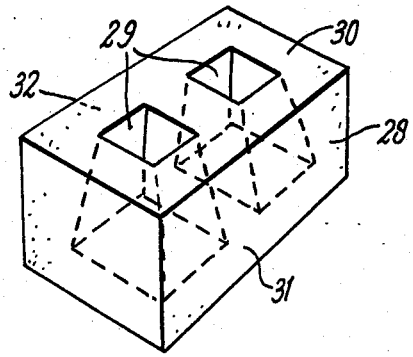
FIG. 4 is a perspective view of a block as used in the wall of FIG. 3.

An alternative wall construction is shown in FIG. 3. In this case the wall 27 is constructed of blocks 28 of the form illustrated in FIG. 4. Each block 28 has two cavities 29 of rectangular planform and which taper towards the upper surface 30 of the block 28. The cavities 29 extend between opposed walls 31,32 of block 28 which form the inner and outer wall parts of the completed wall 27. The blocks 28 are laid 'dry' to form the wall 27 and foamable material 33 is injected into the cavities 29 to form fillets which bond to the lower part of the surfaces of the cavities 29 of the temporarily uppermost course of blocks and also to that part which bounds such cavities 29 of the upper surface 30 of the blocks 28 in the course beneath and which is uncovered by a block 28 in the temporarily uppermost course. A good bond is thereby formed between the blocks 28 in consecutive courses.

By means of the invention a wall may be built in a quick and simple manner without the need for skilled labour. Preferably accurately rectangular bricks or blocks should be used so that the resulting wall will be straight and vertical if built on an accurately prepared base or foundation. However, small discrepancies in the blocks may be compensated by foamable material forcing its way into any small gaps which are formed between adjacent blocks. If a wall built in accordance with the present method is to be rendered a thin rendering coat may be applied with the tendency to "peeping", i.e. the joint lines being visible through the rendering, being eliminated or at least substantially reduced. The present method also avoids the need for storage of sand and cement, the latter being prone to "going-off" in damp weather. In addition rainfall during or immediately after building a wall by the present method is of little or no consequence, whereas it can wash out mortar from a conventional wall and thus damage such a wall. The present method may also be carried out in frosty or other inclement weather which would normally cause postponement of building by conventional methods. Any locally made blocks may be used, thereby saving on transport costs.

As a further variation of the embodiment of FIG. 2, inner and outer differing claddings can be applied to the wall in the manner of the inner cladding 19 shown in FIG. 2. In such a case the gaps 18 left between adjacent blocks of the inner wall portion 12 would preferably be non-aligned with the gaps left between adjacent blocks of the outer wall portion 13.

What we claim is:

1. Method of constructing a cavity wall having first and second spaced single wall portions with a cavity therebetween, said method comprising laying a plurality of building blocks in successive courses in block to block contact without a bonding material therebetween to construct at least said second wall portion and form said cavity wall, and, after each successive temporarily uppermost course of blocks is laid, injecting said foamable material into said cavity in a quantity sufficient when foamed to partially fill the portion of said cavity lying within the temporarily uppermost course of blocks prior to laying the next successive temporarily uppermost course.

2. The method as claimed in claim 1 wherein said quantity of foamable material is sufficient when foamed to fill one fourth of the portion of said cavity lying within said temporarily uppermost course of blocks.

3. The method as claimed in claim 1 wherein additionally a coating is applied to at least one outer face of said wall after construction thereof.

4. The method as claimed in claim 1 wherein joint spaces are left between at least some of the adjacent blocks in any one course and wherein a board is applied to the outermost face of said blocks whereby said foamable material enters said spaces and bonds said blocks and board to each other.

* * * * *